United States Patent [19]

Thomas et al.

[11] 3,941,023

[45] Mar. 2, 1976

[54] CHORD BUTTON ASSEMBLY

[75] Inventors: Howard M. Thomas, North Tonawanda; Richard A. Borowiec, Grand Island, both of N.Y.

[73] Assignee: The Wurlitzer Company, Chicago, Ill.

[22] Filed: June 14, 1974

[21] Appl. No.: 479,339

[52] U.S. Cl. ..... 84/1.01; 84/423; 84/433; 84/443; 84/DIG. 7; 200/5 A; 200/250; 200/340

[51] Int. Cl.[2] ..... G10H 1/00; G10H 5/00

[58] Field of Search.... 84/1.01, 1.17, 423, 433–436, 84/441, 443, DIG. 7, DIG. 8, DIG. 22; 200/1 R, 5 R, 5 A, 237, 238, 250, 293, 296, 340

[56] References Cited

UNITED STATES PATENTS

| | | | |
|---|---|---|---|
| 2,630,503 | 3/1953 | Larsen et al. | 84/423 X |
| 2,694,986 | 12/1960 | Johnson | 84/DIG. 22 |
| 3,032,455 | 5/1962 | Fauser | 84/423 X |
| 3,041,568 | 6/1962 | Bissonette et al. | 84/DIG. 7 |
| 3,205,754 | 9/1965 | Becwar | 84/433 |
| 3,705,254 | 12/1972 | Amano | 84/DIG. 7 |
| 3,708,605 | 1/1973 | Ohno | 84/DIG. 7 |
| 3,715,447 | 2/1973 | Ohno | 84/DIG. 7 |
| 3,769,869 | 11/1973 | Nelson, Jr. | 84/1.01 |
| 3,797,357 | 3/1974 | Thomas et al. | 84/423 |
| 3,855,894 | 12/1974 | Thomas et al. | 84/423 |

*Primary Examiner*—L. T. Hix
*Assistant Examiner*—Stanley J. Wittkowski
*Attorney, Agent, or Firm*—Olson, Trexler, Wolters, Bushnell & Fosse, Ltd.

[57] ABSTRACT

A chord button assembly for use in electronical organs is formed as a unitary assembly. A plastic hinge strip extending the length of the chord selector button area is provided and a plurality of keys or arms extend from the strip and have selector buttons formed at or near terminating ends of the arms in a staggered pattern to extend through openings formed in the chord selector plate. The arms are provided with return spring and electrical contact element receiving recesses which are strategically located to allow selection of multiple chord operation by actuation of a single chord button.

10 Claims, 9 Drawing Figures

FIG.1
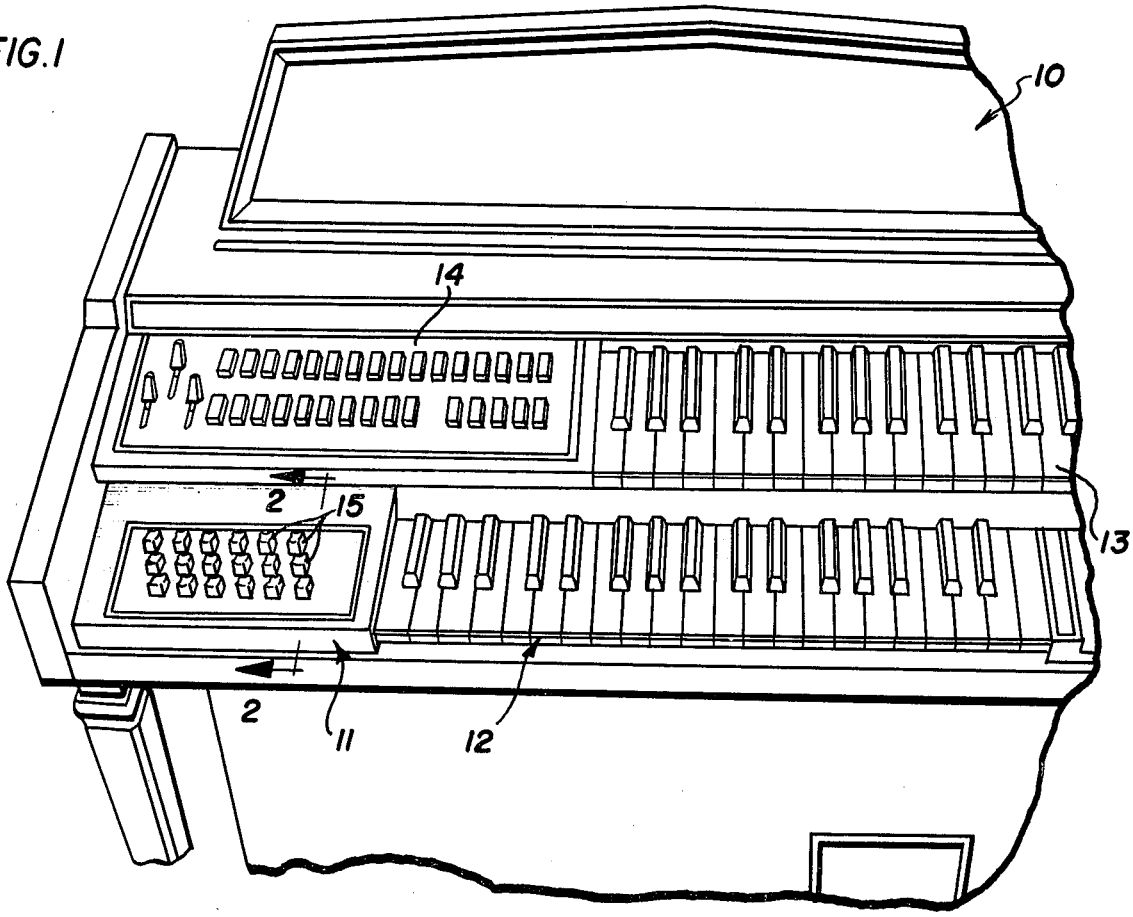
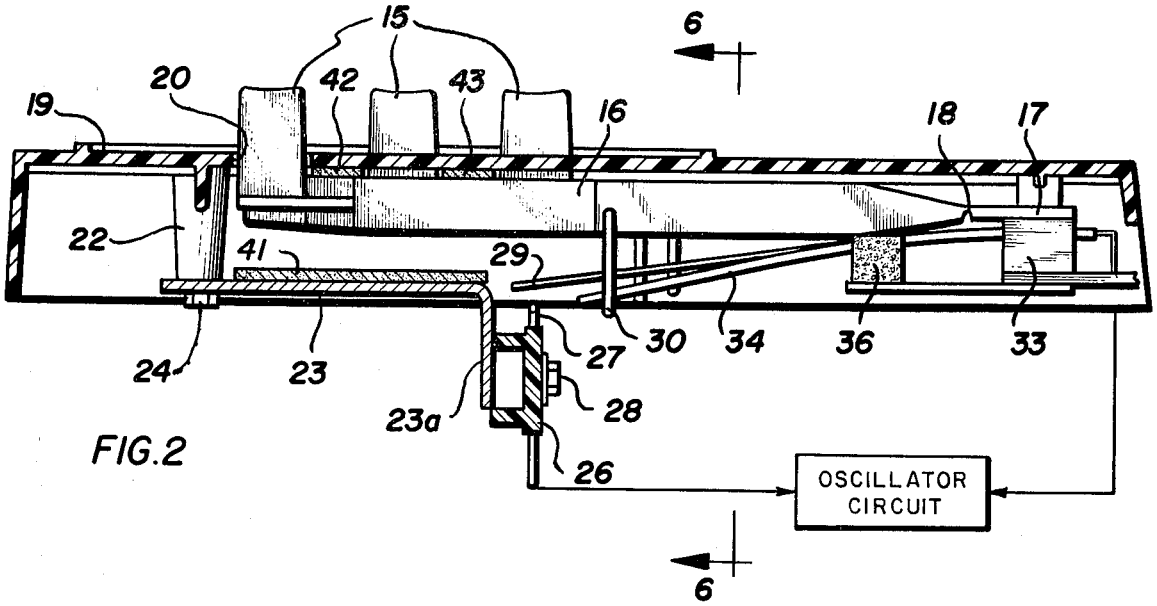
FIG.2

CHORD BUTTON ASSEMBLY

BACKGROUND OF THE INVENTION

This invention relates generally to improvements in selector buttons for electronic musical instruments, and more particularly, to improvements in the chord selector button assembly for electronic organs, and the like. Heretofore, the production of keys and chord buttons for musical instruments, and especially those used in electronic organs, have provided a bar for receiving a separate key or arm mounted thereon for holding the chord button in its proper registry with a cover plate located in the chord button selection area of the electronic organ. Usually these arms are held in place by screws or the like with the entire assembly being mounted by means of mechanical hinge structures added thereto during the assembly operation. Each arm for the chord button has had to be mounted individually, and considerably manual labor and time is required to mount such prior art arrangments. Furthermore, the requirement for dexterity and skilled labor increases the cost for assembling such units.

In accordance with the invention disclosed and claimed in Howard M. Thomas et. al U.S. Pat. No. 3,797,357 ELECTRONIC MUSICAL INSTRUMENT MECHANICAL CONSTRUCTION, sub-assemblies of keys are provided in which a plurality of plastic keys is formed integral with a mounting strip with a flexible section between each key and the mounting strip. Furthermore, in accordance with U.S. Pat. No. 3,797,357, it is necessary to have three sub-assemblies for three different groups of keys, these corresponding to each of three different octaves associated with the black and white keys of the standard piano keyboard. In mounting this structure it is necessary to place three mounting strips one on top of the other on a supporting base. This construction is generally satisfactory for piano-type keys, but a certain amount of hand-labor is necessary for placing each of the sub-assemblies in their proper position and for securing them in place.

A variation on the structure shown in the Thomas et. al. U.S. Pat. No. 3,797,357 is found in the R. A. Becwar U.S. Pat. No. 3,205,754 issued Sept. 4, 1965, which also relates to the construction of the piano-type black and white key arrangement. In this patent the octave group of white or natural keys is formed integral with the mounting strip, and there is an interconnecting flexural strip mounting each key to the mounting strip. Similarly, there is a separate group of sharp or black keys integrally molded with a single mounting strip with a flexural interconnecting strip between each key and the mounting strip. This structural arrangement still presents a problem in that two mounting strips must be secured to a support, one on top of the other.

SUMMARY OF THE INVENTION

Accordingly, it is an object of the present invention to provide a new and improved key structure, particularly useful for the chord button assembly, which is entirely of a single integral molded construction, and wherein each of the buttons is secured to a support arm which, in turn, is connected to the mounting strip by a flexural plastic section.

More specifically, a feature of this invention is a new and improved chord button assembly wherein a plurality of rows of chord buttons are formed on a single mounting strip and protrude through rows of apertures in a plate.

Briefly, the above objects are accomplished by the provision of a chord button assembly which utilizes a single mounting strip and a plurality of keys or button support arms extending therefrom. The keys or buttons are secured near the terminating ends of the support arms which, in turn, are hingedly secured to the mounting strip by a reduced-dimension portion of the molded plastic material. The return spring and contact springs associated with each of the chord buttons is carried within separate recesses formed in a tab at the bottom of the support arm. When the chord note associated with one button is also to be intermingled with a chord note associated with an immediately adjacent button the tabs at the bottom of the support arms are arranged so as to provide common registry of recesses therein for the contact springs associated with the two chord notes to be played from the single button. The entire structure provides means for making simple electrical and mechanical connections to the chord buttons thereby substantially reducing the assembly time and cost for such chord button assemblies.

Many other objects, features and advantages of this invention will be more fully realized and understood from the following detailed description when taken in conjunction with the accompanying drawings wherein like reference numerals throughout the various views of the drawings are intended to designate similar elements or components.

BRIEF DESCRIPTION OF THE DRAWINGS

FIG. 1 is a fragmentary perspective view of an electronic organ utilizing the chord button assembly constructed in accordance with the principles of this invention;

FIG. 2 is a sectional view taken along line 2—2 of FIG. 1;

DETAILED DESCRIPTION OF THE ILLUSTRATED EMBODIMENTS

Figure 3:
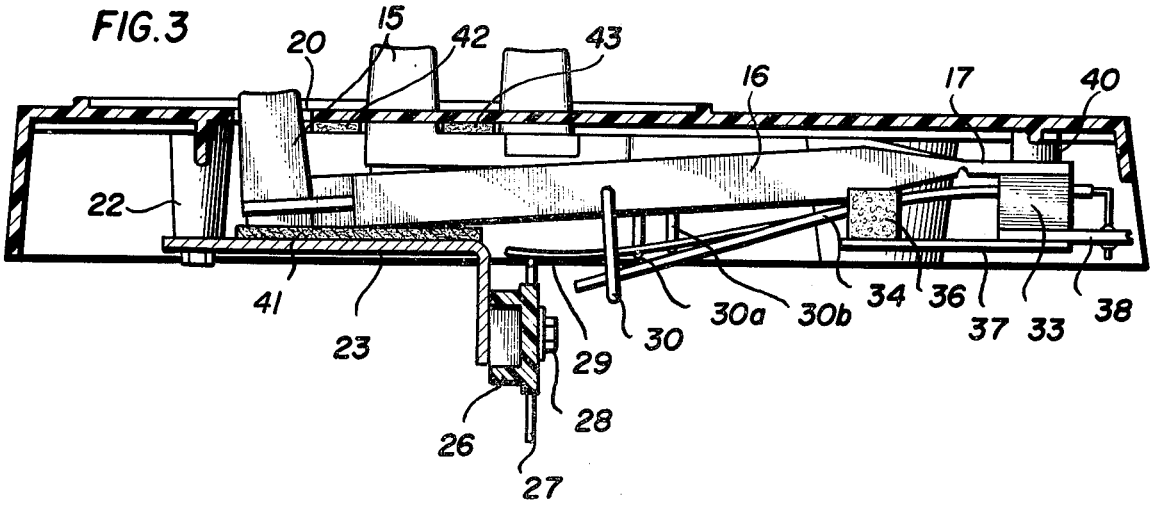
FIG. 3 is a sectional view similar to that of FIG. 2 but illustrating one of the chord buttons in an actuated position.

Referring now to FIG. 1 there is seen an electronic organ which is designated generally by reference numeral 10 and wherein the chord button assembly of the present invention is utilized. Here the chord button assembly is designated generally by reference numeral 11 and is positioned immediately adjacent the lower manual of natural and sharp keys 12, as is customary in the art. An upper manual 13 has positioned adjacent thereto a plurality of selector switches designated generally by reference numeral 14. When playing the electronic organ, combined chord notes of minor, major and seventh chords can be obtained by depressing selective ones of the plurality of chord buttons 15 associated with the chord button assembly 11.

Most advantageously, the chord button assembly of this invention provides a plurality of immediately adjacent keys or chord buttons 15 secured to a corresponding plurality of associated integrally formed arms 16 which are secured to a single elongated mounting strip 17 by means of a hinge portion 18 formed intermediate thereof. The hinge portion 18 is a reduced thickness of the molded plastic material which makes up the unitary structure of the chord buttons, arms and mounting strip, as best seen in FIG. 2.

The chord button assembly 11 includes a support plate 19 having a plurality of spaced-apart apertures 20 formed therein and arranged in staggered rows as seen in FIGS. 1 and 2. The apertures 20 are illustrated as being rectangular in configuration to accept correspondingly shaped chord buttons. However, it will be understood that the apertures may be round or oval to accept round or oval buttons if desired. The support plate 19 has a plurality of spaced-apart mounting bosses 22 depending from the top surface thereof and receives an L-shaped plate or bracket 23 which is held in place by a corresponding plurality of screws 24. The L-shaped plate 23 extends substantially the length of the plurality of arms and buttons 16 and 15, respectively, and includes an insulating support bar 26 which supports a plurality of contact elements 27. The insulating support bar 26 is secured to the downwardly-directed portion 23a of the L-bracket 23 by suitable fasteners here illustrated by reference numeral 28.

The contact elements 27 are connected to appropriate circuit points of the electronic organ for connection therewith by a movable electronic contact element 29 associated with each of the chord buttons 15. The movable electronic contact element 29 fits into a recess 31 formed in a tab member 30, as best seen in the sectional view of FIG. 6.

The mounting strip 17 is secured to the support plate 19 and held in position by means of a terminal barrier strip or holding block 33 through which passes the plurality of electric contacts 29 and spring-biasing wire elements 34. The spring-biasing wire elements 34 urge the chord button 15, together with its associated arm 16, upwardly to a nonactuated position, as seen in the drawings of FIGS. 1 and 2. However, when any one of the chord buttons 15 is actuated, as best seen in FIG. 3, the associated electronic contact element 29 engages the contact element 27 and the electronic musical note is reproduced. To eliminate the possiblity of noise a foam rubber strip 36 is positioned immediately adjacent the end portion of the arms 16 and is held in place by a metal plate 37 formed as part of a printed circuit board 38. The printed circuit board 38 is electrically connected to the respective ones of the plurality of electrical contact elements 29 to energize appropriate oscillator circuits associated with the circuit board, as is well-known in the art. The circuit board 38 is illustrated herein as only a fragmentary portion and extends rearwardly of the mounting plate to be positioned beneath the selector keyboard 14, FIG. 1. The printed circuit board 38 and the terminal barrier strip 33 are held in place by suitable screws or rivets extending therethrough and into a mounting boss 40 formed on the underside of the support plate 19.

As best seen in FIGS. 2 and 3 the length of each of the tabs 30 of immediately adjacent keys of the three rows is different, as indicated by reference numerals 30, 30a and 30b, so that they engage the return spring wires 34 and electrical contact elements 29 equally along the sloping line as indicated in FIG. 2.

To dampen or substantially eliminate the noise of actuation of the chord buttons 15 a resilient pad member 41 is positioned immediately beneath the buttons and engages the underside of the arm portions supporting the buttons. Therefore rapid, vigorous manipulation of the chord buttons will produce virtually no additional outside and unwanted noise as a result.

To further dampen the noise of actuation of movement of the chord buttons resilient strips 42 and 43 are placed immediately adjacent the respective rows of apertures 20, as best seen in FIGS. 2 and 3, so that the upper surface of the arm members 16 will impinge upon the resilient strips rather than upon the hard surface of the support plate 19. All of the chord buttons 15 and their associated arms 16 are formed during a single molding operation, as for example either by injection or pour molding of plastic material. Therefore only a single mounting strip 17 is needed for mounting of all of the chord buttons.

Figure 4:
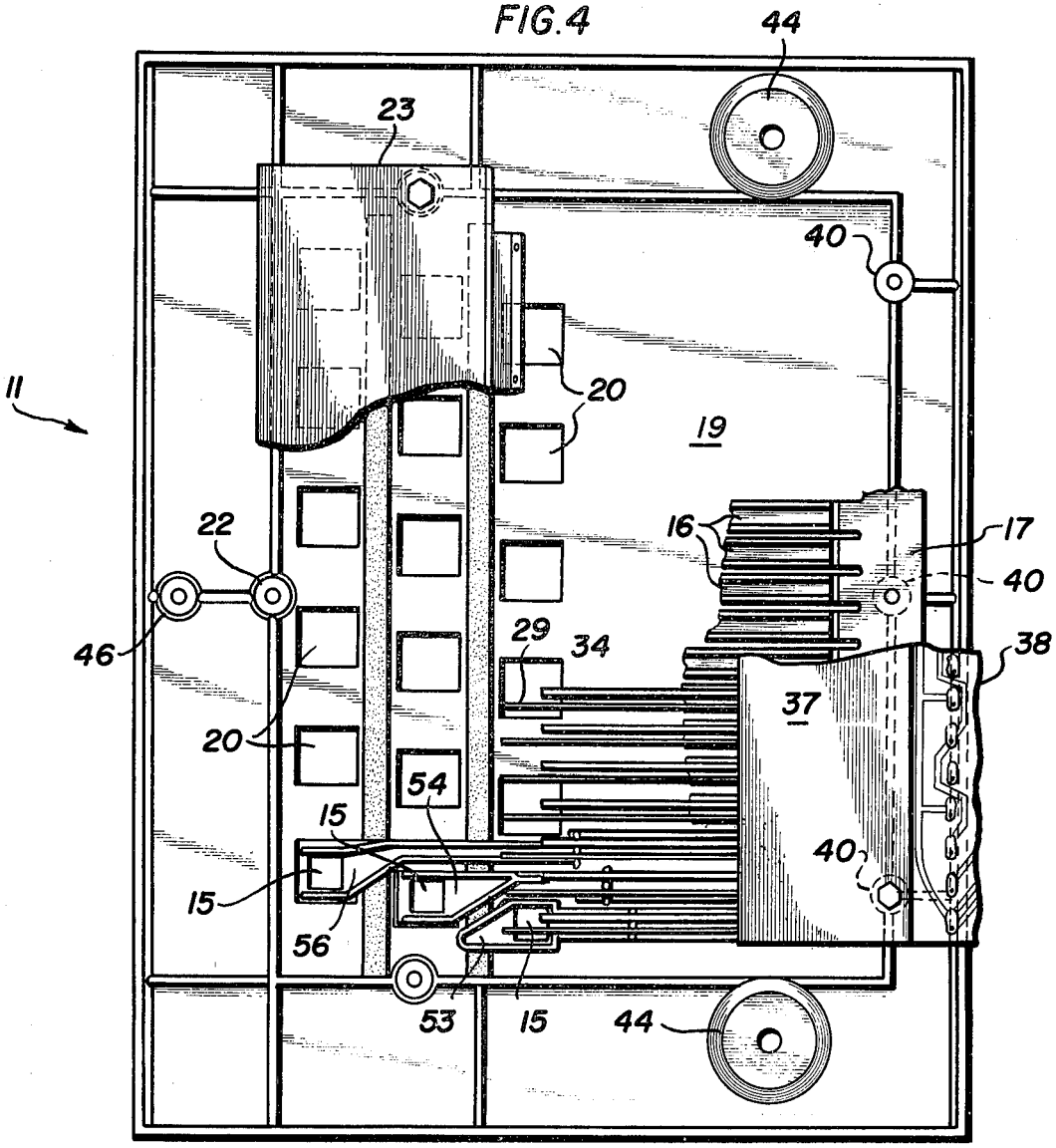
FIG. 4 is a fragmentary plan view with portions thereof broken away to illustrate the construction of the chord button assembly of this invention.

As best seen in FIG. 4 the plurality of arms 16 is divided into three groups each group associated with a different row of the apertures 20. For example, every third arm is a different length and in the illustrated embodiment the shortest of the arms forms one group of chord buttons associated with major chords while the intermediate length of arms forms another group of chord buttons associated with the minor chords and the longest of the arms is still another group of chord buttons associated with the seventh chord notes. The chord button assembly 11, FIG. 4, is secured to the organ 10 by means of mounting bosses 44 located on opposite sides of the plate and a mounting boss 46 formed centrally along the front edge of the plate.

Figure 6:
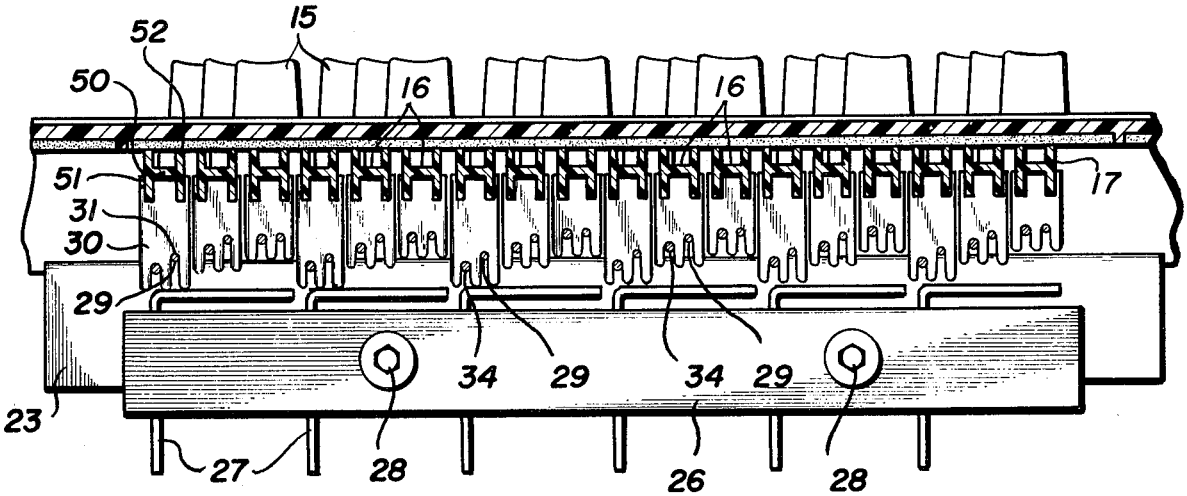
FIG. 6 is a sectional view taken along line 6—6 of FIG. 2.

As best seen in FIG. 6 the plurality of groups of buttons 15 are staggered so that immediately adjacent arms 16 associated with the buttons 15 can be formed integrally with the elongated mounting strip 17 and still provide sufficient lateral space between the arms for free movement during actuation of the associated buttons. FIG. 6 also illustrates that each of the arms is substantially H-shaped in the crosssection having a web portion 50 intermediate a pair of rib portions 51 and 52. FIG. 6 further illustrates that each of the arms associated with a separate chord button has its own biassing spring 34 and its own electrical contact element 29. While the biasing spring 34 is illustrated as being of larger diameter than the electronic contact element 29 it will be understood that the reverse condition can exist by utilizing different materials.

FIG. 4 further illustrates the general configuration of the marginal portion extending about the pushbuttons 15 so that they more readily nest close to one another as they are mounted to the underside of the plate 19 and inserted through the aperture 20. Here the shortest of the actuating arms 16 has an angularly disposed tab portion 53 while the intermediate length arm has an angularly disposed web portion 54 disposed immediately adjacent to the tab portions 53 and of complementary configuration. The longest of the arms 16 has an angularly disposed web portion 56 as illustrated.

Figure 5:
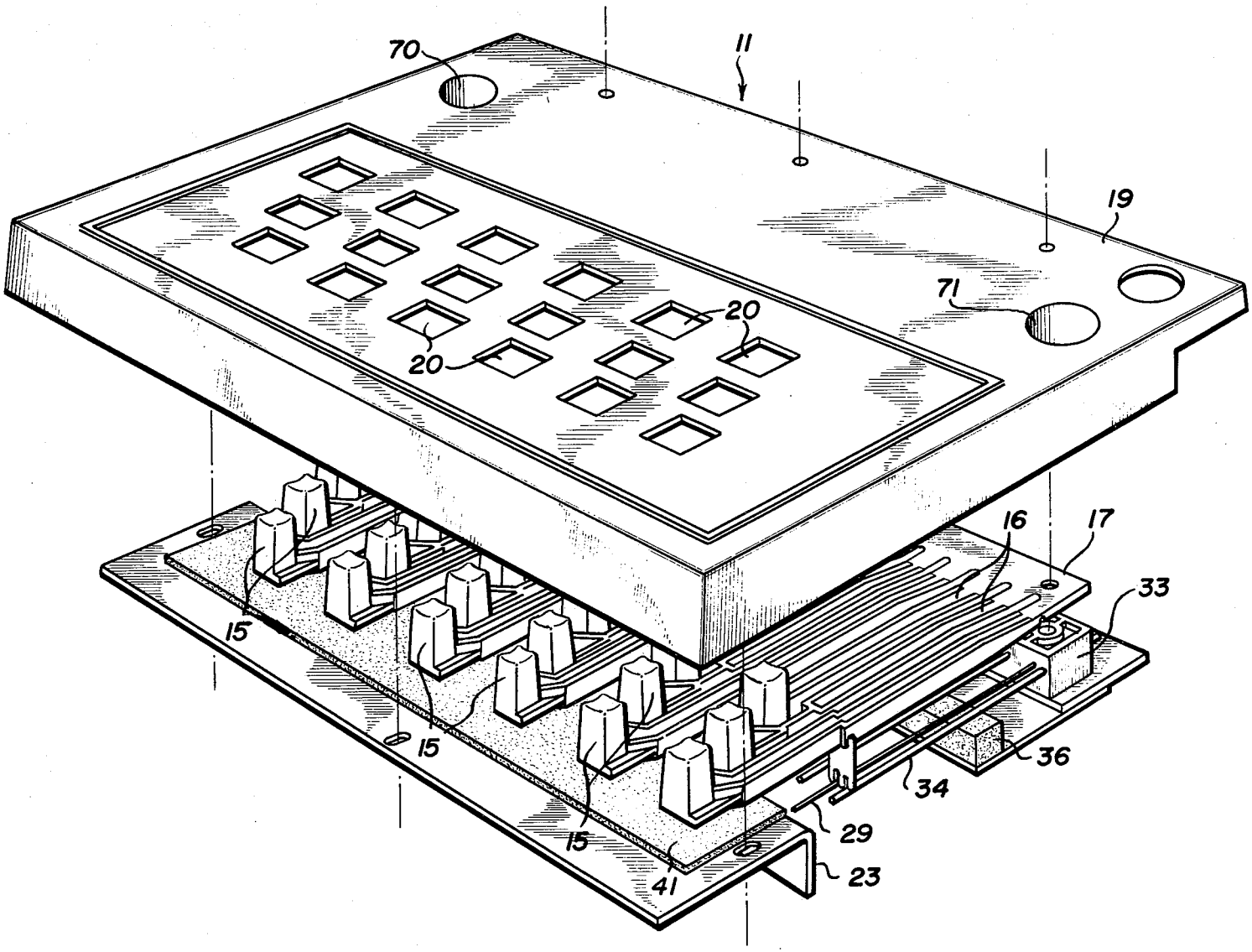
FIG. 5 is an exploded perspective view of the chord button assembly of FIG. 4.

FIG. 5 is a perspective exploded view of the chord button assembly 11 and illustrates the mounting plate 19 as having a pair of diametrically opposed circular recesses 70 and 71 into which may be inserted the heads of fasteners such as screws or bolts. This portion of the mounting plate 19 is covered by the tab selector plate 14, seen in FIG. 1. However should the selector plate 14 not cover this portion of the support plate 19 a decorative cover plate may be utilized. It will be noted from FIG. 4 that the apertures 70 and 71 coincide with the mounting bosses 44 on the underside thereof. Therefore the entire chord button assembly 11 can be preassembled utilizing the plurality of integrally formed chord buttons, arms and mounting strip as illustated here and above.

Figure 7:
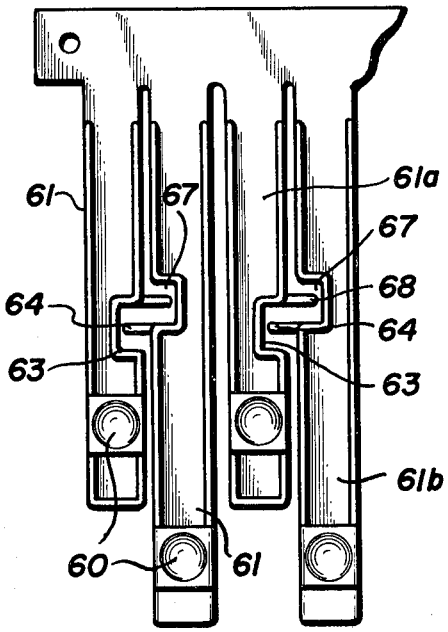
FIG. 7 is a fragmentary plan view of a chord button assembly illustrating an alternative form of construction in accordance with the principles of this invention.
Figure 8:
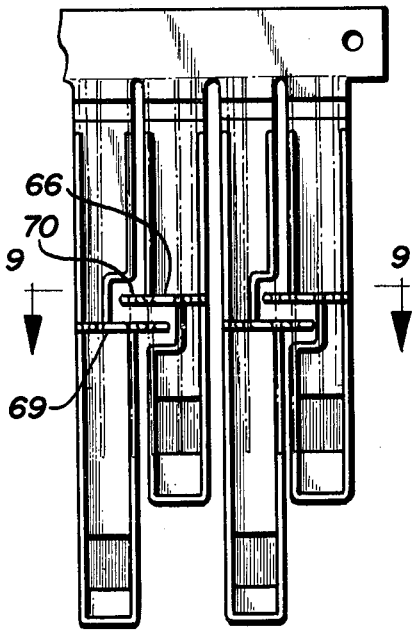
FIG. 8 illustrates a bottom view of the fragmentary portion of FIG. 7.
Figure 9:
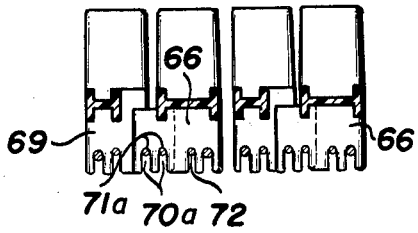
FIG. 9 illustrates an end sectional view taken along line 9—9 of FIG. 8.

FIGS. 7, 8 and 9 illustrate an alternate embodiment of a chord key button structure which is also constructed in accordance with the principles of this invention in that all of the immediately adjacent key or button and arms are formed integrally with a single elongated mounting strip. In this instance the keys are so arranged to make electrical contact of a multitude of different oscillators to provide a chord note of all the necessary frequencies by actuation of a single chord button. In this illustrated embodiment the chord buttons 60 are secured near the terminating ends of elongated arms 61 which are here illustrated as being divided into two groups 61*a* and 61*b* of short and long arms, respectively for two rows of buttons. Formed in each of the arms of group 61*a* is a notch 63 to receive a transverse extended portion 64 of a depending tab 66. Similarly, the long arms of the group 61*b* has notches 67 to receive the elongated portions 68 of tabs 69. This configuration enables the immediately adjacent keys of the two groups to actuate similar electrical contact elements while isolating still other electrical contact elements from one another. For example, the tab portions 66 and 69 have a certain one of the recesses formed therein in longitudinal alignment to receive the electrical contact elements as best seen in FIG. 9. The aligned recesses are here designated by reference numeral 70*a* in the tab portion 66 to receive electrical contact elements 71*a* therein. On the other hand, the tab portion 66 also receives an electrical contact element 72 which is not actuated by actuation of the immediately adjacent arm associated with the tab 69. Therefore during actuation of each of the chord buttons 60 three electrical contact elements are actuated; two of these three electrical contact elements are also actuated when the next immediately adjacent chord button is actuated.

What has been described is a simple and efficient chord button assembly which has all of the chord buttons and associated arms formed immediately adjacent to one another and to a single elongated mounting strip, and which buttons, arm and mounting strip can be formed during a single molding operation of plastic material and the like. Accordingly, variations, modifications of this invention may be effected without departing from the spirit and scope of the novel concept disclosed and claimed herein.

The invention is claimed as follows:

1. A key assembly for use in a musical instrument the keyboard comprising; an elongated mounting strip for attachment to a support structure located within an electronic musical instrument, a plurality of immediately adjacent keys, and a plurality of flexural portions respectively integrally connecting said plurality of keys to said mounting strip for common connection to said support structure, each of said keys having a tab extending downwardly therefrom, each of said tabs having a first recess formed therein to receive a return spring and a second recess formed therein to receive an electric contact element.

2. The key assembly as set forth in claim 1 wherein said keys have notches formed in one side thereof, said tab extends laterally from its associated key to extend into said notch formed in the immediately adjacent key, thereby providing actuation of common electric contact elements from selected ones of immediately adjacent keys.

3. A chord button assembly for an electronic musical instrument, comprising; an elongated mounting strip for attachment to a support structure on the electronic musical instrument, a plurality of arms immediately adjacent to one another and integrally formed with said elongated mounting strip and hingedly connected thereto, said arms forming a plurality of groups of arms of different length, chord buttons formed integrally with said arms at the ends thereof for fitting into spaced-apart apertures in a plate structure of the electronic musical instrument, said chord buttons being arranged in rows and spaced-apart in said rows in accordance with the different lengths of the separate arms, a tab formed on the bottom of each of said arms, a first recess formed in each of said tabs to receive a return spring, and a second recess formed in each of said tabs to receive an electrical contact element for actuation of oscillator circuits associated with the electronic musical instrument when the corresponding chord button is actuated.

4. The chord button assembly for an electronic musical instrument as set forth in claim 3 wherein said tabs extend laterally a distance greater than the width of said arms and said arms have notches formed in the side thereof to receive the lateral extent of said tabs, said tabs having aligned pairs of recesses to receive said electrical contact elements therein for actuation by chord buttons immediately adjacent thereto.

5. The chord button assembly for an electronic musical instrument as set forth in claim 4 wherein said plurality of groups of buttons are two to provide two rows of chord buttons for the electronic musical instrument.

6. The chord button assembly for an electronic musical instrument as set forth in claim 4 wherein said plurality of groups of buttons are three to provide three rows of chord buttons for the electronic musical instrument.

7. A chord button assembly for an electronic musical instrument comprising: a mounting plate having a plurality of rows of apertures formed therein through which chord buttons extend, an elongated mounting strip secured to said mounting plate at one margin thereof, a plurality of arms integrally secured to said mounting strip and hingedly connected thereto and extending from said margin to said plurality of rows of apertures, chord buttons formed at the ends of said arms and arranged to fit through said apertures to form a plurality of rows of chord buttons, a tab formed at the bottom of each of said arms, a first recess formed in each of said tabs to receive a return spring, and a second recess formed in each of said tabs to receive an electronic contact element.

8. The chord button assembly for an electronic musical instrument as set forth in claim 7 wherein said tabs extend laterally a distance greater than the width of said arms and said arms have notches formed in the side thereof to receive the lateral extent of said tabs, said tabs having aligned pairs of recesses to receive said electrical contact elements therein for actuation by immediately adjacent chord buttons.

9. The chord button assembly for an electronic musical instrument as set forth in claim 8 wherein said plurality of groups of buttons are two to provide two rows of chord buttons for the electronic musical instrument.

10. The chord button assembly for an electronic musical instrument as set forth in claim 8 wherein said plurality of groups of buttons are three to provide three rows of chord buttons for the electronic musical instrument.

* * * * *